United States Patent [19]

Walther et al.

[11] 4,408,920

[45] Oct. 11, 1983

[54] POCKET TOOTHBRUSH

[75] Inventors: Mike C. Walther; Manuel A. Mena-Reyes, both of Bronx, N.Y.

[73] Assignee: Ready Brush, Inc., New York, N.Y.

[21] Appl. No.: 269,246

[22] Filed: Jun. 1, 1981

[51] Int. Cl.[3] ..... A46B 11/04; A46B 17/04

[52] U.S. Cl. ..... 401/176; 15/176; 401/269; 401/287

[58] Field of Search ..... 401/172, 176, 190, 174, 401/173, 269, 287; 15/176

[56] References Cited

U.S. PATENT DOCUMENTS

| | | | |
|---|---|---|---|
| 660,823 | 10/1900 | Sherman | 401/176 |
| 860,839 | 7/1907 | Stevens | 401/176 |
| 1,362,937 | 12/1920 | Grace | 401/174 |
| 1,742,157 | 12/1929 | Christian | 401/176 |
| 2,199,293 | 4/1940 | Ruskin | 401/176 |
| 2,206,726 | 7/1940 | Lasater | 15/167 R |
| 2,250,758 | 7/1941 | French | 401/176 |
| 2,299,564 | 10/1942 | Castillo | 401/172 |
| 2,642,606 | 6/1953 | Aschenbach | 401/176 |
| 3,094,130 | 6/1963 | Wiener | 401/190 |
| 3,103,935 | 9/1963 | Woodrow | 132/84 |
| 3,256,894 | 6/1966 | Sherman | 132/84 |
| 3,261,367 | 7/1966 | Pickering | 132/84 |
| 3,292,644 | 12/1966 | Ericson | 132/84 |
| 3,417,762 | 12/1968 | Hall | 132/84 |
| 3,432,245 | 3/1969 | Hudson | 401/132 |
| 3,521,795 | 7/1970 | Langhjelm | 401/176 |
| 3,589,823 | 6/1971 | Hendrickson | 401/176 |
| 3,879,139 | 4/1975 | Dahl | 401/176 |
| 3,917,420 | 11/1975 | Watson | 401/286 |
| 4,039,261 | 8/1977 | Evans | 401/132 |
| 4,109,339 | 8/1978 | Dietrich . | |
| 4,277,194 | 7/1981 | Smith | 401/173 |

FOREIGN PATENT DOCUMENTS

| | | | |
|---|---|---|---|
| 886082 | 11/1971 | Canada | 401/176 |
| 2400514 | 10/1974 | Fed. Rep. of Germany | 401/176 |
| 2526893 | 12/1976 | Fed. Rep. of Germany | 401/172 |
| 455783 | 6/1913 | France | 401/176 |
| 468496 | 4/1914 | France | 401/176 |
| 520043 | 3/1955 | Italy | 15/167 R |
| 512130 | 7/1956 | Italy | 401/176 |
| 2261 | of 1879 | United Kingdom | 401/176 |

*Primary Examiner*—Clyde I. Coughenour
*Attorney, Agent, or Firm*—Curtis Ailes

[57] ABSTRACT

The toothbrush has an exterior structure resembling a traditional fountain pen case including a cylindrical end-cap cover which is removable to reveal the brush bristles. The device includes a main cylindrical body shaft having a cross section at the bristle end which is reduced to substantially a minor segment of a circle, and having toothbrush bristles extending transversely and confined within the circular profile of the transverse section of the cylindrical body shaft so that the end cap cover covers the bristles without interference when placed over the bristle end of the body shaft.

6 Claims, 9 Drawing Figures

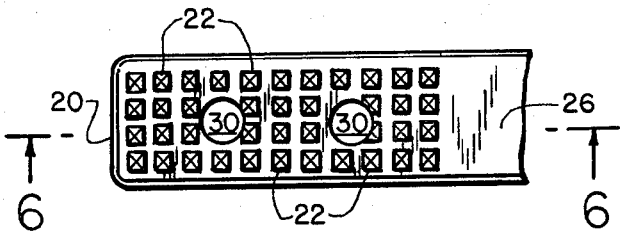
FIG.5
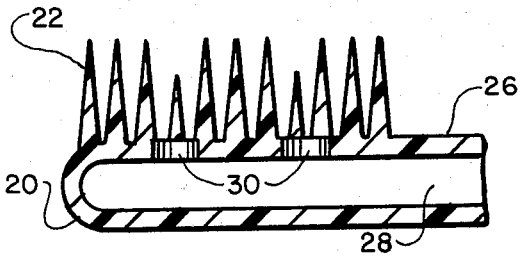
FIG.6
FIG. 7
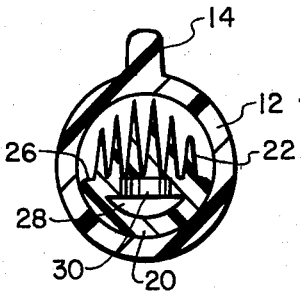
FIG.8
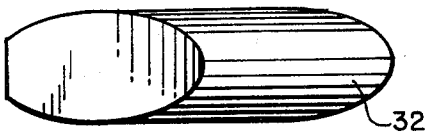
FIG.9
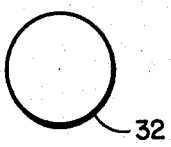

POCKET TOOTHBRUSH

This invention relates to a compact portable toothbrush which is especially adapted to be carried in the pocket of the user so as to be convenient for use at any time.

BACKGROUND OF THE INVENTION

The advantages of dental hygiene are well known. As a part of the very best dental care, it is important to brush the teeth soon after every meal. Unfortunately, a toothbrush and toothpaste are not always readily available.

It is one important object of the present invention to provide a portable toothbrush which is easily carried in the pocket and which is thus available whenever it is required for brushing teeth in order to promote dental hygiene.

Another object of the invention is to provide an improved portable toothbrush in which the brush portion is thoroughly protected from being soiled or contaminated before use, even when it is carried in the pocket of the user prior to use as a toothbrush.

Another object of the invention is to provide an improved portable toothbrush which includes its own self-contained charge of dentrifrice together with means for dispensing the dentifrice conveniently.

Another object of the invention is to provide a portable toothbrush which is so economical that it can be disposable after a single use.

Other objects and advantages of the invention will be apparent from the following description and the accompanying drawings.

SUMMARY OF THE INVENTION

In carrying out the invention there is provided a pocket toothbrush having an exterior structure resembling a traditional fountain pen case including a cylindrical screw cap cover, a main cylindrical body shaft having exterior screw threads engagable by the threads of said screw cap cover, said cylindrical body shaft having a cross section at one end which is reduced to substantially a minor segment of a circle, said reduced section end having toothbrush bristles extending transversely and confined within the circular profile of the transverse section of the remainder of the main cylindrical body shaft, said cylindrical screw cap cover being adapted to cover said reduced section end and said bristles when placed over said reduced section end and engaged with said exterior threads on said body shaft.

BRIEF DESCRIPTION OF THE DRAWINGS

FIG. 5 is an enlarged top view detail of the bristle end of the device illustrating the construction of the bristles in greater detail.

FIG. 6 is an enlarged side detail view of the bristle end of the device and further illustrating the construction of the bristles.

FIG. 7 is a sectional end view taken at section 7—7 of FIG. 1 and drawn to the same scale as FIG. 6, and further showing the construction of the bristles and showing how the bristles are surrounded and protected by the cover.

FIG. 8 is an enlarged detail side view of a toothpaste cartridge for use in the invention.

FIG. 9 is an enlarged detail end view of the toothpaste cartridge of FIG. 8.

DESCRIPTION OF PREFERRED EMBODIMENTS

Figure 1:
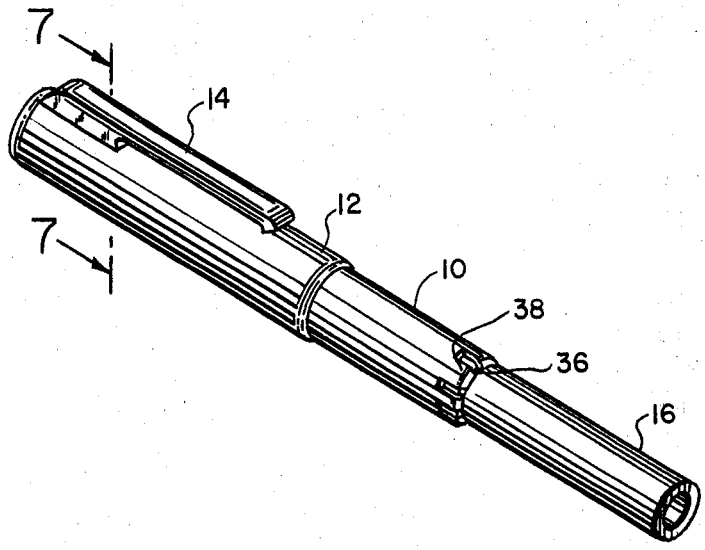
FIG. 1 is a full side view of a preferred form of the invention with the cover in place over the bristles.

FIG. 1 is a side view of a preferred embodiment of the invention showing a cylindrical body shaft 10 and a cover member 12 which includes a clip 14 for holding the device in the pocket of the user. The device also preferably includes a plunger member 16 extending into the end of the main cylindrical body shaft 10.

The exterior surface of the body shaft 10 preferably includes screw threads 18 (visible only in FIG. 2) engagable by interior screw threads at the open end of the cap 12.

Figure 2:
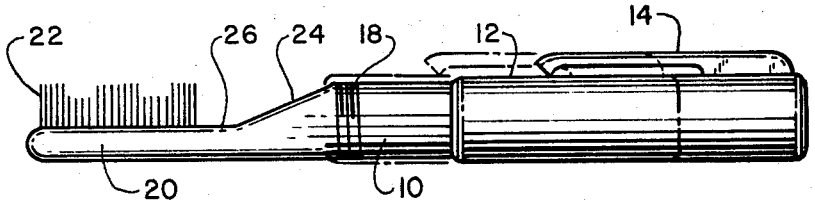
FIG. 2 is another side view of the embodiment of FIG. 1 showing the cover removed from the bristles and placed on the opposite end of the device.

FIG. 2 is a side view corresponding to FIG. 1 in which the cap 12 has been removed from the left end of the device, uncovering and revealing the brush end of the toothbrush, the cap being placed over the opposite end of the main cylindrical body shaft 10 and enclosing the plunger 16. The screw threads of the cap 12 engage the screw threads 18 on the body shaft in this position as well as in the position shown in FIG. 1.

The exposed left end of the device as shown in FIG. 2 includes a reduced section portion 20 which carries the bristles 22. The main cylindrical body shaft 10 is reduced by a slanted upper surface transition plane 24, and a surface plane 26 which is essentially parallel to the axis of the cylinder. These surface planes essentially cut off the cylinder shape, the plane 26 providing a base for the bristles 22. The length of the bristles is confined within the circular profile of the transverse section of the full cylindrical section of the main cylindrical body shaft 10, so that when the cover 12 is in place over the bristles as pictured in FIG. 1, the cover does not interfere with the bristles and neatly covers all of them. This feature is illustrated very clearly in FIG. 7. FIG. 7 is taken at section 7—7 in FIG. 1. As seen in FIG. 7, the reduced portion 20 of the body shaft 10 is reduced to substantially a minor segment of a circle in cross section.

Figure 3:
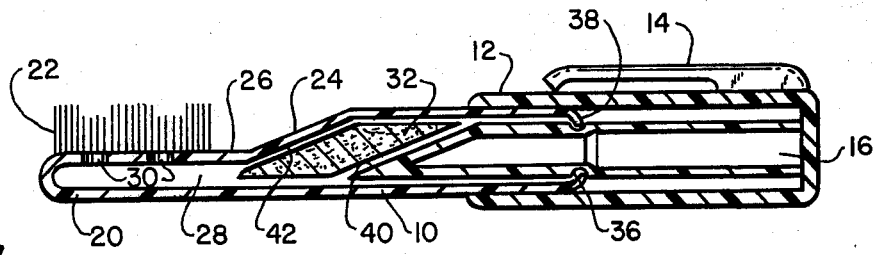
FIG. 3 is a sectional side view of the device of FIG. 1 in the same condition as illustrated in FIG. 2.

FIG. 3 is a sectional side view of the toothbrush structure in the same aspect as in FIG. 2, and revealing the preferred interior structure thereof. As shown in FIG. 3, the cylindrical body shaft 10 includes an interior passage 28 which extends into the reduced section end 20. The passage 28 includes two termination openings 30 which are in the area at the base of the toothbrush bristles 22. A cartridge 32 of toothpaste is provided within the interior passage 28, and a movable plunger 16 is provided for forcing the toothpaste from the cartridge 32 through the narrow part of the passage 28 and out through the termination openings 30 into the toothpaste bristles 22 for use.

Figure 4:
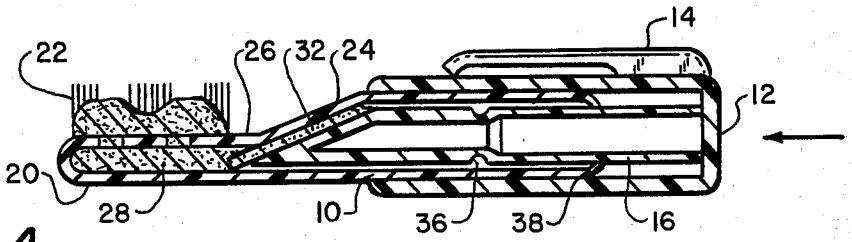
FIG. 4 is a sectional side view corresponding to FIG. 3, but showing the toothpaste ejection plunger in the inwardly compressed position after the toothpaste has been ejected and dispensed into the bristles.

FIG. 4 is a sectional side view corresponding to FIG. 3, and showing the plunger 16 in the advanced position for the feeding of the toothpaste to the bristles. The plunger 16 is advanced by the user by simply exerting sufficient axial inward pressure.

The plunger 16 and the cylindrical body shaft 10 preferably include an inter-engaging detent means for maintaining the plunger 16 in the extended position illustrated in FIGS. 1 and 3 until operation for ejection of the toothpaste is required. That detent means preferably includes a circumferential indentation 36 around the exterior surface of the plunger 16, and a plurality of fingers 38 at the outer end of the cylindrical body shaft 10 arranged for engagement within the circumferential indentation 36. The material of the cylindrical body shaft is preferably a synthetic resin material which is fairly rigid when made in a heavy section, but which is much more flexible if made in a thin section. Accordingly, the portion forming the fingers 38 is of reduced section and of greater flexibility. Furthermore, as shown at FIG. 1, the fingers are separated by axial slots to provide for greater flexibility. The detent arrangement for maintaining the position of the plunger until use is very worthwhile since it prevents any damage to the toothpaste cartridge 32 while the toothbrush is being carried. However, the detent force is low enough so that it is easily overcome by manual force for injection of the plunger.

As illustrated in FIG. 3, part of the passage 28 provides a space within the interior end of the full cylindrical bore of the cylindrical body shaft 10 for the accommodation of the charge of toothpaste in the form of a cartridge 32. That space is defined by the inner end of the full cylindrical bore opposite the plane 24 and by the inner end 40 of the plunger 16, and that space essentially is a cylinder with substantially parallel axially oppositely aligned faces which are tilted substantially away from a plane normal to the cylinder axis. This provides substantially slanted opposing cylinder faces, one of the faces being defined by the interior end 40 of the plunger 16, and the other one of the cylinder faces being defined by the inner end of the full cylindrical bore opposite the surface plane 24.

The cartridge 32 of toothpaste which is provided within the toothpaste charge space substantially fills that charge space and has the cylindrical shape with parallel slanted faces as just described above for the space. The toothpaste cartridge 32 may consist of conventional toothpaste enclosed within a synthetic resin film container. At least the tip of the cartridge film which extends most closely to the termination openings 30 is easily rupturable under the pressure created by the plunger 16 to permit the discharge of the toothpaste from the cartridge into the brush bristles 22.

FIG. 8 is an enlarged top view of the toothpaste cartridge 32 as viewed perpendicular to the axis thereof.

FIG. 9 is an enlarged end view of the toothpaste cartridge 32.

FIG. 5 is a top detail view, somewhat enlarged, showing only the bristles 22 and the reduced end 20 of the body, and also showing the termination openings 30 for ejection of the toothpaste.

FIG. 6 is a side sectional view of that same portion of the structure, and drawn to the same scale, and particularly showing the preferred construction wherein the bristles are molded from the same material as the body shaft. Again, the material is preferably a synthetic resin which is rigid when formed in heavy sections, and flexible enough to serve the purpose of the bristles when formed in sections having smaller dimensions. Forming the bristles and the body in a single piece is extremely economical, and has been found to provide a very satisfactory, though inexpensive brush.

All of the parts of the toothbrush are preferably composed of the same synthetic resin, more commonly referred to simply as "plastic". A number of different synthetic resins may be employed, including, but not necessarily restricted to, polyethylene, and one or more of the nylons. The preferred material for the body is a polypropylene, and the preferred material for the cap is a polystyrene.

Despite all of its features, the toothbrush of the invention can be produced so inexpensively that it may be considered as a disposable item which can be carried in the pocket, and used once, and then disposed of.

While all of the features are preferably employed together in the exact combination shown, it will be apparent that many of the advantages of the invention can be achieved with an even simpler structure, for instance, without the toothpaste feeding mechanism, and having only the features clearly shown for instance in FIGS. 1 and 2.

While this invention has been shown and described in connection with a particular preferred embodiment, it is apparent that various changes and modifications, in addition to those mentioned above, may be made by those who are skilled in the art without departing from the basic feature of the invention. Accordingly, it is the intention of the applicant to protect all variations and modifications within the true spirit and valid scope of this invention.

We claim:

1. A pocket toothbrush having an exterior structure resembling a traditional fountain pen case including a removable cylindrical end cap cover, a main cylindrical body shaft over at least one end of which said end cap cover fits and having exterior protruding means engagable with the interior of said end cap cover to retain said end cap cover, said cylindrical body shaft having a cross section at one end which is reduced to substantially a minor segment of a circle, said reduced section end having toothbrush bristles extending transversely and confined within the circular profile of the transverse section of the remainder of the main cylindrical body shaft, said cylindrical end cap cover being adapted to cover said reduced section end and said bristles when placed over said reduced section end and engaged with said protruding means on said body shaft, said end cap cover being adapted to be attached to the end of said body shaft opposite to said reduced section end by telescoping over said opposite end of said body shaft, said cylindrical body shaft including an interior passage extending into said reduced section end and having at least one termination opening in the area at the base of said toothbrush bristles, means for feeding toothpaste through said passage and through said opening into said bristles at the time of use, said interior passage in said cylindrical body shaft being widened out to a full cylindrical bore at the end opposite said reduced section end, said means for feeding the toothpaste through said passage comprising a movable plunger extending into said cylindrical bore in said main cylindrical body shaft, said full cylindrical bore including an interior space for the accommodation of a charge of toothpaste to be fed to said bristles by the operation of said movable plunger, said interior space for the charge of toothpaste being defined by the inner end of said full cylindrical bore and by the inner end of said plunger as essentially a cylinder with substantially parallel axially oppositely aligned faces which are tilted substantially away from a plane normal to the cylinder axis to provide substantially slanted opposing cylinder faces, one of said faces being defined by the interior end of said plunger, and the other one of said cylinder faces being defined by the inner end of said full cylindrical bore in the transition of said interior passage to the portion connected to said termination opening at the base of said toothbrush bristles, said toothbrush bristles being of graded lengths when viewed in an end profile and with the longest bristles being positioned at the center and successfully shorter bristles positioned towards the sides so that the tips of said bristles form a semi-circular end profile to fit within said cylindrical end cap cover.

2. A toothbrush as claimed in claim 1 wherein said bristles and said body shaft are molded from one piece of a synthetic resin material, the bristles being molded with small cross sectional dimensions to provide for flexibility in the bristles and the body shaft portion being formed with substantially greater thickness dimensions to provide for a substantial rigidity compared to the bristle portions.

3. A toothbrush as claimed in claim 2 wherein a cartridge of toothpaste is provided within said toothpaste charge space and substantially filling said charge space, said toothpaste cartridge comprising a body of toothpaste surrounded by a synthetic resin film container.

4. A toothbrush as claimed in claim 3 wherein at least the portion of said synthetic resin film container for said toothpaste charge which is in the inner end of said cavity for said charge of toothpaste and positioned most closely to said toothbrush bristles is designed to be easily ruptured in response to the pressure exerted by said plunger to permit the escape of toothpaste from said cartridge for delivery through said interior passage to said bristles.

5. A pocket toothbrush having an exterior structure resembling a traditional fountain pen case including a removable cylindrical end cap cover, a main cylindrical body shaft over at least one end of which said end cap cover fits and having exterior protruding means engagable with the interior of said end cap cover to retain said end cap cover, said cylindrical body shaft having a cross section at one end which is reduced to substantially a minor segment of a circle, said reduced section end having toothbrush bristles extending transversely and confined within the circular profile of the transverse section of the remainder of the main cylindrical body shaft, said cylindrical end cap cover being adapted to cover said reduced section end and said bristles when placed over said reduced end and engaged with said protruding means on said body shaft, said cylindrical body shaft including an interior passage extending into said reduced section end and having at least one termination opening in the area at the base of said toothbrush bristles, means for feeding toothpaste through said passage and through said opening into said bristles at the time of use, said interior passage in said cylindrical body shaft being widened out to a full cylindrical bore at the end opposite said reduced section end, said means for feeding the toothpaste through said passage comprising a movable plunger extending into said cylindrical bore in said main cylindrical body shaft, said cylindrical body shaft and said plunger including inter-engaging detent means for maintaining said plunger in the extended position until operation for ejection of toothpaste is required, said inter-engaging means comprising a circumferential indentation in said plunger, and a plurality of fingers comprising the outer end of said cylindrical body shaft arranged for engagement within said circumferential indentation.

6. A toothbrush as claimed in claim 2 or claim 3 wherein said toothbrush bristles are of graded lengths when viewed in an end profile and with the longest bristles being positioned at the center and successively shorter bristles positioned towards the sides so that the tips of said bristles form a semi-circular end profile to fit within said cylindrical end cap cover.

* * * * *